US008266727B2

(12) United States Patent
Lee

(10) Patent No.: US 8,266,727 B2
(45) Date of Patent: Sep. 18, 2012

(54) PADDING DEVICE FOR SPORTS

(76) Inventor: Wei-Ta Lee, Tainan (TW)

( * ) Notice: Subject to any disclaimer, the term of this patent is extended or adjusted under 35 U.S.C. 154(b) by 323 days.

(21) Appl. No.: 12/750,895

(22) Filed: Mar. 31, 2010

(65) Prior Publication Data

US 2011/0239355 A1 Oct. 6, 2011

(51) Int. Cl.
*A41D 27/26* (2006.01)

(52) U.S. Cl. ..... 2/461; 2/462

(58) Field of Classification Search ..... 2/267, 268, 2/459, 460, 464, 465, 467, 462, 461, 463, 2/468

See application file for complete search history.

(56) References Cited

U.S. PATENT DOCUMENTS 4,404,690 A * 9/1983 Farquharson ..... 2/420
5,029,341 A * 7/1991 Wingo, Jr. ..... 2/462
5,226,192 A * 7/1993 Jones et al. ..... 2/461
5,530,966 A * 7/1996 West ..... 2/462
5,551,082 A * 9/1996 Stewart et al. ..... 2/465
D606,261 S * 12/2009 Tobergte ..... D29/101.2
2004/0128748 A1* 7/2004 Monica ..... 2/462
2007/0151004 A1* 7/2007 Brassill ..... 2/461
2010/0095441 A1* 4/2010 Wingo ..... 2/462

* cited by examiner

*Primary Examiner* — Khoa Huynh
*Assistant Examiner* — Anna Kinsaul
(74) *Attorney, Agent, or Firm* — Alan Kamrath; Kamrath IP Lawfirm, PA

(57) ABSTRACT

A padding device for sports includes an outer armor having two main pads and a front guard board. Two linings are mounted in the outer armor. Reinforced portions, reinforcing blocks, and reinforced sections are formed on an outer surface of the outer armor and include apertures and perforations. Vents are formed in areas of each lining corresponding to the reinforced portions, reinforcing blocks, and reinforced sections. The vents provide rapid dissipation of heat generated by the wearer during sporting, providing comfort wearing. The reinforced portions, reinforcing blocks, and reinforced sections reinforce the areas where the vents are formed.

8 Claims, 7 Drawing Sheets

PADDING DEVICE FOR SPORTS

BACKGROUND OF THE INVENTION

The present invention relates to a padding device for sports and, more particularly, to a padding device for foot ball with enhanced resistance to impact.

Padding devices or pads are generally required in vigorous sports such as foot ball to protect the players while allowing vigorousness in the game. The padding devices generally include an outer armor made of plastic material with sufficient toughness for absorbing impact. The padding devices also include a lining inside the outer armor. The lining is made of foam material to absorb residual impact. The players sweat a lot and generate a considerable amount of heat during the games. The linings of the currently available padding devices do not have any vents for dissipating the heat, leading to discomfort to the players.

Thus, a need exists for a padding device with enhanced heat dissipating effect.

BRIEF SUMMARY OF THE INVENTION

The present invention solves this need and other problems in the field of heat dissipation for padding devices for sports by providing, in a preferred form, a padding device including two arcuate main pads each having a front section, a rear section, and a shoulder section intermediate the front and rear sections. Each main pad further includes an outer, first surface and an inner, second surface. A plurality of perforations extends from the outer, first surface through the inner, second surface. A first interconnecting member is mounted to the shoulder section of the inner, second surface of each main pad. The main pads are connected to each other. A first assembling member is fixed to the front section of the inner, second surface of each main pad. The padding device further includes two linings each formed of a buffer pad. Each lining includes front and rear sides and a top side intermediate the front and rear sides. Each lining further includes outer and inner layers. Each lining further includes a first vent extending from the outer layer through the inner layer. The first vent of each lining includes a first inner periphery in the buffer pad. A second interconnecting member is mounted to the outer layer of the top side of each lining. The padding device further includes two first enveloping members each having first and second ends. The first end of each first enveloping member is fixed to the inner layer of one of the linings. Each first enveloping member surrounds one of the first vents. An annular second assembling member is engaged to the second end of each first enveloping member. Each first enveloping member envelopes the inner periphery of one of the first vents but does not cover the first vent. Each second assembling member is located on an outer side of the outer layer of one of the main pads. Each lining is engaged to the inner, second surface of one of the main pads with the front side aligned with the front section, with the rear side aligned with the rear section, and with the top side aligned with the shoulder section. Each first interconnecting member is releasably engaged with one of the second interconnecting members. Each second assembling member is releasably engaged with one of the first assembling members to keep the inner periphery of each first vent enveloped by one of the first enveloping members. The outer layer of each lining abuts the inner, second surface of one of the main pads. The top sides of the linings together define an upper opening. The front and rear sides of the linings together define a lower opening and two side openings. Each perforation is aligned with one of the first vents to provide an air passageway.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
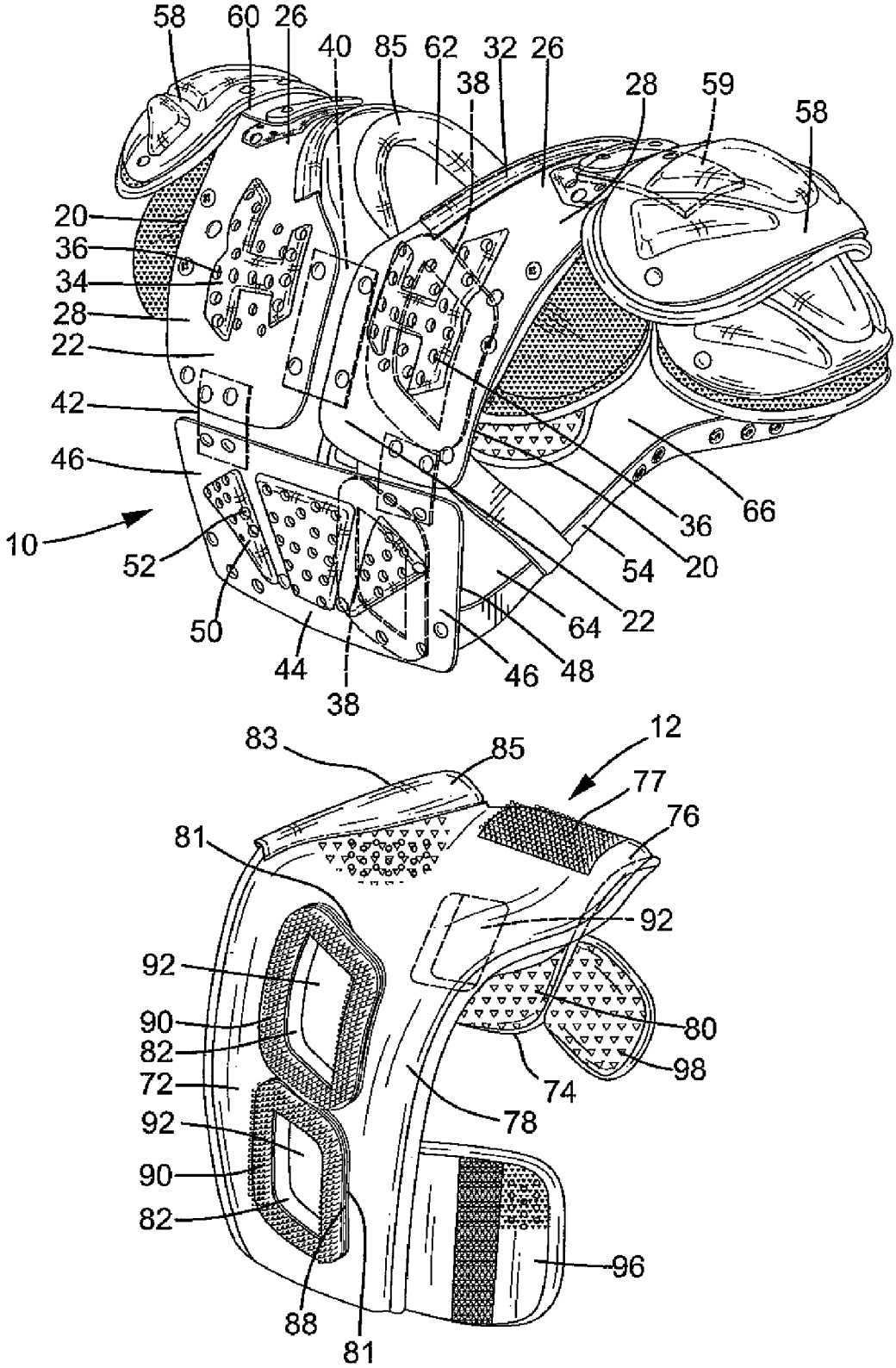
FIG. 1 shows an exploded, perspective view of a padding device according to the preferred teachings of the present invention with a lining removed for clarity.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "upper", "inner", "outer", "front", "rear", "side", "end", "portion", "section", "annular", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A padding device for sports according to the preferred teachings of the present invention is shown in the drawings and generally designated 10. According to the preferred form shown, padding device 10 includes two main pads 20 made of plastic material to form a light structure with sufficient toughness and rigidity. Each main pad 20 includes a front section 22, a rear section 24, and a shoulder section 26 intermediate front and rear sections 22 and 24. Each main pad 20 further includes an outer, first surface 28 and an inner, second surface 30. Shoulder section 26 of each main pad 20 has an arcuate recessed portion 32. First surface 28 of each main pad 20 includes a protruded reinforced portion 34 formed on front section 22. First surface 28 of each main pad 20 further includes a protruded reinforcing block 35 formed on rear section 24. A plurality of perforations 36 extends from first surface 28 through second surface 30 in areas of each main pad 20 corresponding to reinforced portions 34 and reinforced blocks 35. A buckle 56 is provided on an outer side of rear section 24 of each main pad 20.

Figure 2:
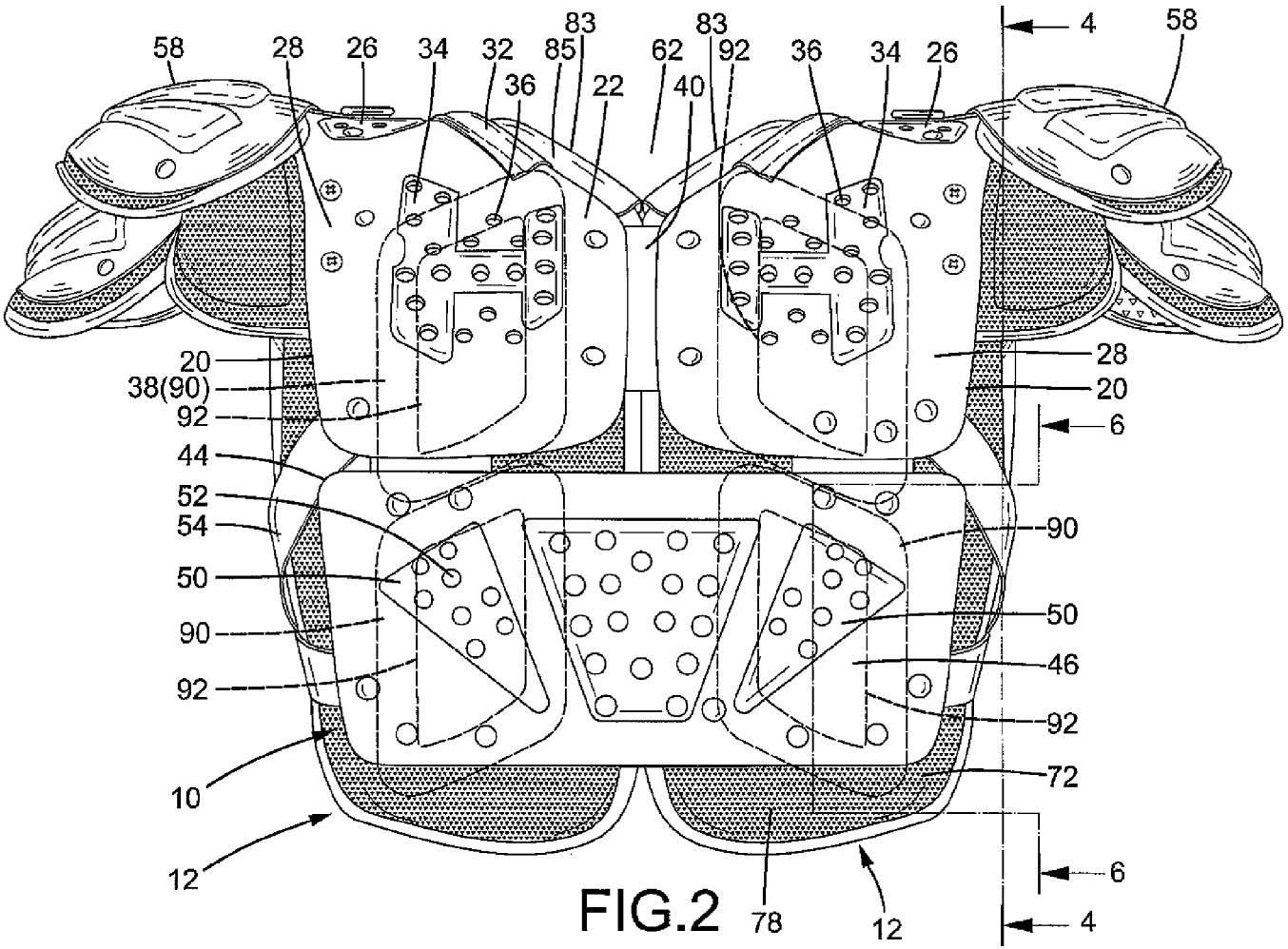
FIG. 2 shows a front elevational view of the padding device of FIG. 1.
Figure 3:
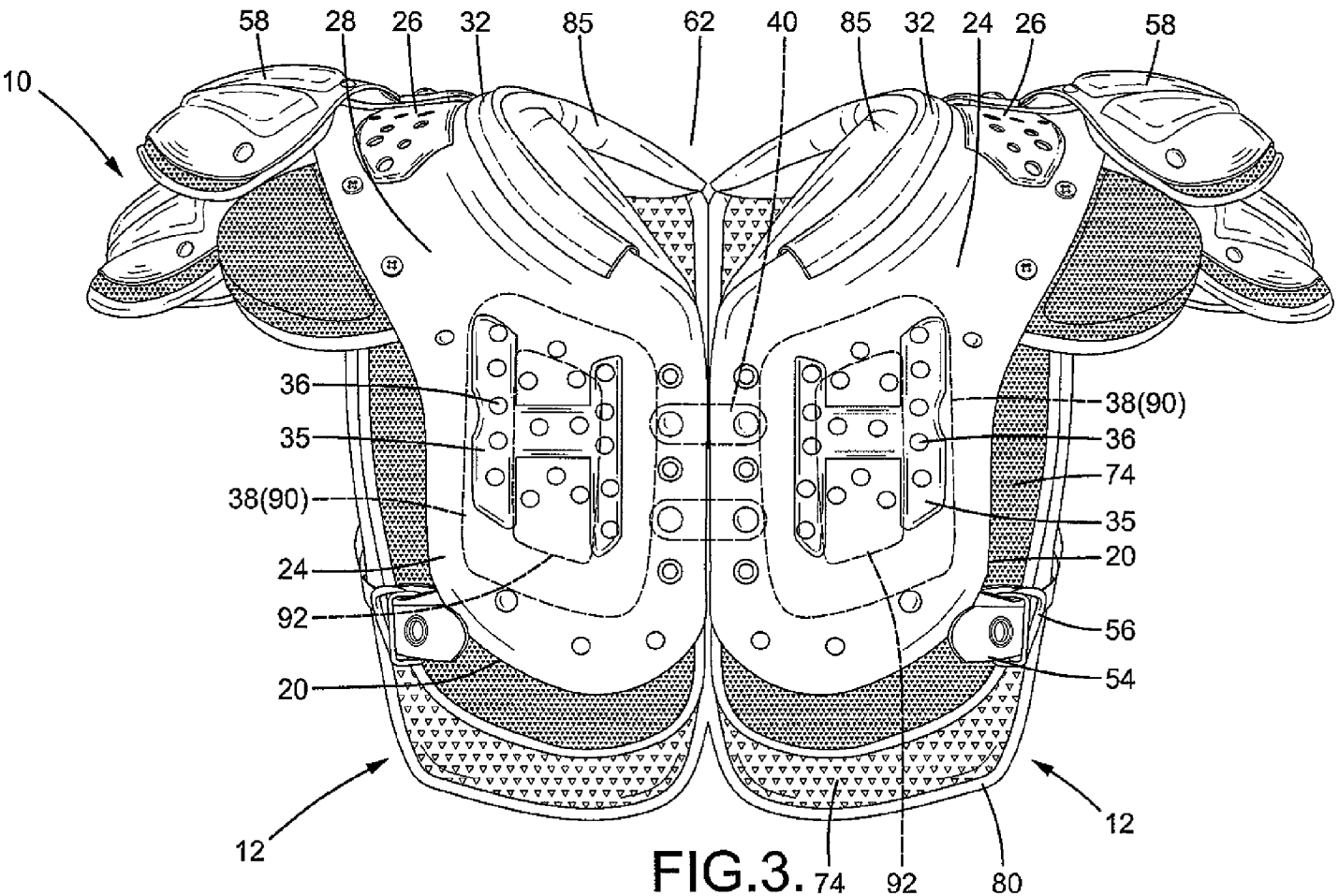
FIG. 3 shows a rear elevational view of the padding device of FIG. 1.

According to the preferred form shown, padding device 10 further includes three first connecting members 40 on second surfaces 30 of main pads 20. Main pads 20 are symmetric to each other. One of first connecting members 40 is provided between front sections 22 of main pads 20 (FIG. 2). The remaining two first connecting members 40 are riveted to rear sections 24 of main pads 20 (FIG. 3). Main pads 20 are, thus, connected as a single member with arcuate recessed portions 32 defining a space allowing passage of a head of a wearer. A first assembling member 38 is formed on each of front and rear sections 22 and 24 of second surface 30 of each main pad 20. Each first assembling member 38 is annular and defines an opening. A first interconnecting member 59 is mounted to shoulder section 26 of second surface 30 of each main pad 20.

According to the preferred form shown, padding device 10 further includes a front guard board 44 below front sections 22 of main pads 20 and having spaced outer and inner faces 46 and 48. Three reinforced sections 50 protrude from outer face 46 of front guard board 44. A plurality of apertures 52 extends from outer face 46 through inner face 48 of front guard board 44.

According to the preferred form shown, padding device 10 further includes two shoulder pads 58 each connected by a third connecting member 60 to shoulder section 26 of one of main pads 20 such that shoulder pads 58 are movable relative to main pad 20.

According to the preferred form shown, padding device 10 further includes two second connecting members 42 each connecting front section 22 of one of main pads 20 to front guard board 44. Furthermore, each second connecting member 42 is fixed by rivets to second surface 30 of one of main pads 20 and inner face 48 of front guard board 44. Thus, front sections 22 of main pads 20 and front guard board 44 are connected by second connecting members 42. A strap 54 is provided between an outer edge of front section 22 of each main pad 20 and an outer edge of front guard board 44 for engagement with a buckle 56 to adjust a spacing between rear section 24 and front section 22/front guard board 44.

According to the preferred form shown, padding device 10 further includes two linings 12 each formed of foam material to form a buffer pad 68. Specifically, each buffer pad 68 is bent to an arcuate shape conforming to an outer armor formed by main pads 20 and front guard board 44. Each buffer pad 68 includes outer and inner layers 78 and 80 formed by cloth. A plurality of vents 70 extends through each buffer pad 68 and is intermediate and covered by outer and inner layers 78 and 80. Each lining 12 includes a front side 72 aligned with front section 22 of one of main pads 20. Each lining 12 further includes a rear side 74 aligned with rear section 24 of one of main pads 20. Each lining 12 further includes a top side 76 intermediate front and rear sides 72 and 74 and aligned with shoulder section 26 of one of main pads 20. Top side 76 of each lining 12 has a recess 83 aligned with arcuate recessed portion 32 of one of main pads 20. A lining strip 85 is received in recess 83 of top side 76 of each lining 12 and filled with soft material to provide lining strip 85 with desired softness. A first vent 92 extends from outer layer 78 through inner layer 80 of each lining 12 in an area of front side 72 corresponding to reinforced portion 34 of one of main pads 20. A second vent 92 extends from outer layer 78 through inner layer 80 of each lining 12 in an area of rear side 74 corresponding to reinforcing block 35 of one of main pads 20. A third vent 92 extends from outer layer 78 through inner layer 80 of each lining 12 in an area of front side 72 corresponding to one of reinforced sections 50 of front guard board 44. First, second, and third vents 92 are of identical structure and identical function at different locations in the most preferred form shown. Third vents 92 are below first vents 92. Each first vent 92 has a first annular periphery 93 in one of buffer pads 68. Each second vent 92 has a second annular periphery 93 in one of buffer pads 68. Each third vent 92 has a third annular periphery 93 in one of buffer pads 68. Buffer pads 68 are, thus, exposed via first, second, and third vents 92. A front pad 96 is provided to an outer end of front side 72 of each lining 12. A rear pad 98 is provided to an outer end of rear side 74 of each lining 12.

According to the preferred form shown, each lining 12 further includes three first engaging members 81 on outer layer 78 and respectively at first, second, and third vents 92. Specifically, each first engaging member 81 surrounds and does not cover first, second, and third vents 92.

According to the preferred form shown, each lining 12 further includes a first enveloping member 82 corresponding to each first vent 92, a second enveloping member 82 corresponding to each second vent 92, and a third enveloping member 82 corresponding to each third vent 92. Each of first, second, and third enveloping members 82 is preferably made of elastic cloth and includes spaced first and second ends 84 and 86 and spaced first and second sides 87 and 89. First side 87 of first end 84 of each of first, second, and third enveloping members 82 is fixed to inner layer 80 of one of first, second, and third vents 92. Furthermore, each of first, second, and third enveloping members 82 surrounds but not covers first, second, and third vents 92.

Figure 5:
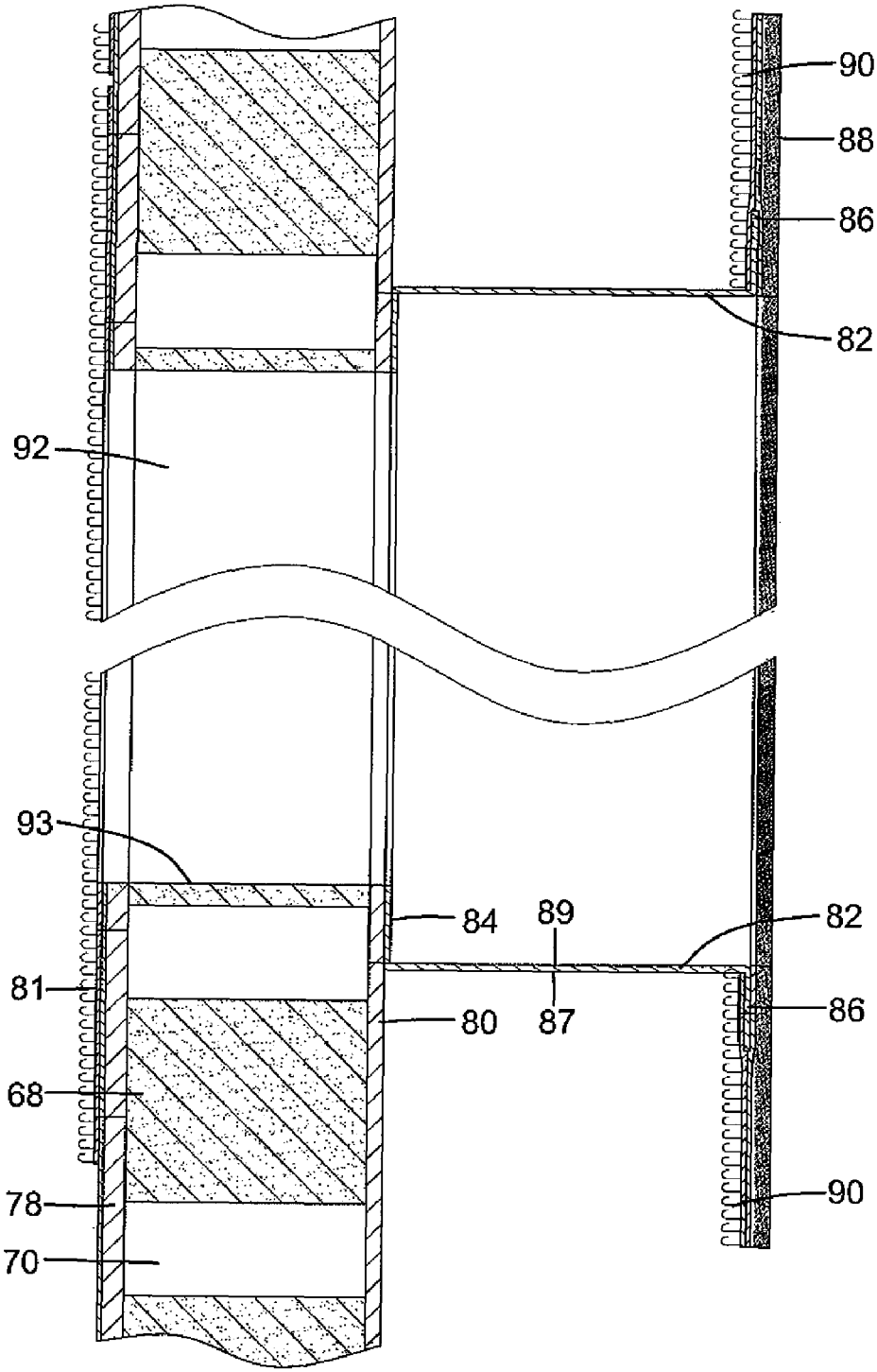
FIG. 5 shows an enlarged cross sectional view of a portion of the padding device of FIG. 1 with an enveloping member in a state before engagement.

According to the preferred form shown, each lining 12 further includes three second engaging members 88 and three second assembling members 90. Each second engaging member 88 is annularly fixed to second side 89 of second end 86 of one of first, second, and third enveloping members 82. Each second engaging member 90 is annularly fixed to first side 87 of second end 86 of one of first, second, and third enveloping members 82 and overlaps one of second engaging members 88 without covering first, second, and third vents 92. In FIG. 5, second end 86 of each of first, second, and third enveloping members 82 is not extended through the associated one of first, second, and third vents 92 but is located at a side of inner layer 80.

According to the preferred form shown, each lining 12 further includes a second interconnecting member 77 on outer layer 78 of top side 76. Each second interconnecting member 77 releasably engages with one of first interconnecting members 59.

Figure 6:
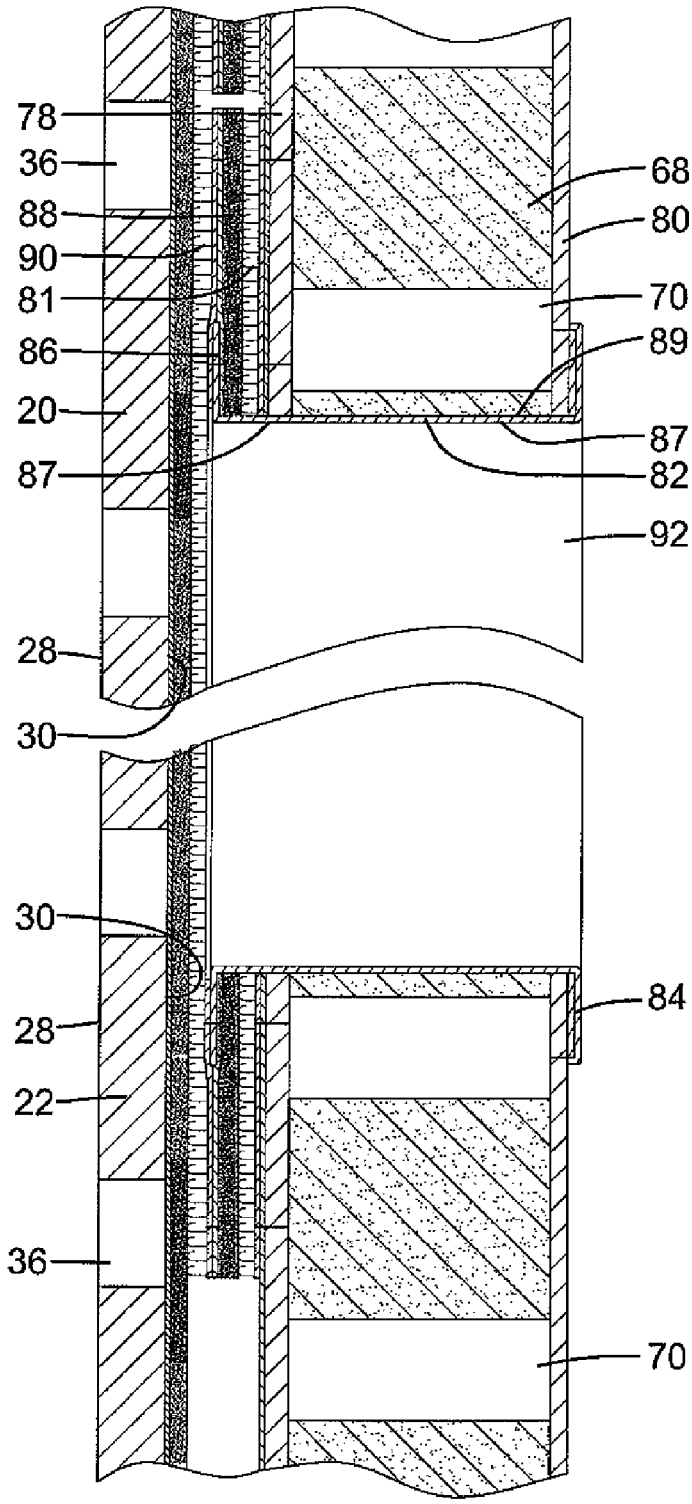
FIG. 6 shows a cross sectional view of the padding device of FIG. 2 according to section line 6-6 of FIG. 2 with the enveloping member of FIG. 5 in an engaged state.

According to the preferred form shown, before engagement of each lining 12 with the outer armor, each second engaging member 88 is releasably engaged with one of first engaging members 81. Namely, the second end 86 of each of first, second, and third enveloping members 82 together with one of second engaging members 88 and one of second assembling members 90 of FIG. 5 are extended out of outer layer 78 so that second side 89 of each of first, second, and third enveloping members 82 abuts one of first, second, and third inner peripheries 93. Thus, each second engaging member 88 and one of second assembling members 90 are turned inside out until second engaging member 88 faces and engages with one of first engaging members 81, as shown in FIG. 6. Note that second end 86 of each of first, second, and third enveloping members 82 envelopes and protects one of first, second, and third inner peripheries 93 without covering first, second, and third vents 92. Second assembling member 90 is on outer layer 78, as shown in FIGS. 1 and 6. Note that first and second engaging members 81 and 88 can be made of hook and loop fasteners.

Figures 4, 4A:
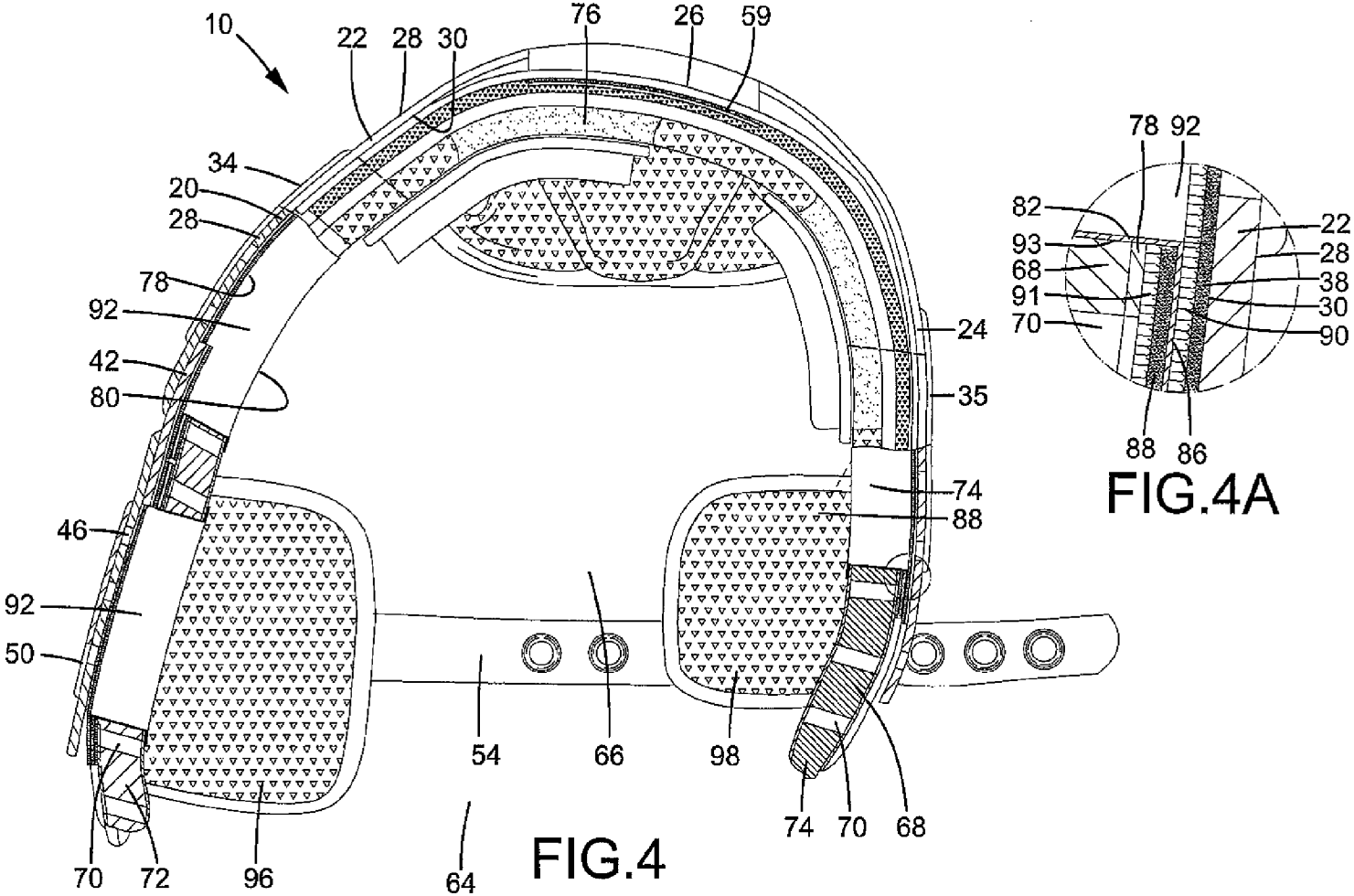
FIG. 4 shows a cross sectional view of the padding device of FIG. 2 according to section line 4-4 of FIG. 2.
FIG. 4A shows an enlarged view of a circled portion of FIG. 4.

With reference to FIGS. 1, 4, and 6, each lining 12 is engaged with second surfaces 30 of one of main pads 20 with front side 72 aligned with front section 22, with rear side 74 aligned with rear section 24, and with top side 76 aligned with shoulder section 26. Second assembling member 90 at one of first vents 92 is releasably engaged with first assembling member 38 on front section 22 of one of main pads 20. Second assembling member 90 at one of second vents 92 is releasably engaged with first assembling member 38 on rear section 24 of one of main pads 20. Second assembling member 90 at third vent 92 is engaged with first assembling member 38 at front guard board 44. Reinforced portions 34 are aligned with first vents 92. Reinforcing blocks 35 are aligned with second vents 92. Reinforced sections 50 are aligned with third vents 92. Recesses 83 and lining strips 85 are aligned with arcuate recessed portions 32. Thus, each lining 12 can be releasably mounted to outer layers 78 of the outer armor, forming padding device 10. Main pads 20 and linings 12 together define an upper opening 62 between recesses 83, a lower opening 64 between front and rear sides 72 and 74, and two side openings 66 at two sides of padding device 10. Front and rear pads 96 and 98 are located in side openings 66. First assembling members 38 and second assembling members 90 can be in the form of hook and loop fasteners. Likewise, first interconnecting member 59 and second interconnecting member 77 can be in the form of hook and loop fasteners.

Figure 7:
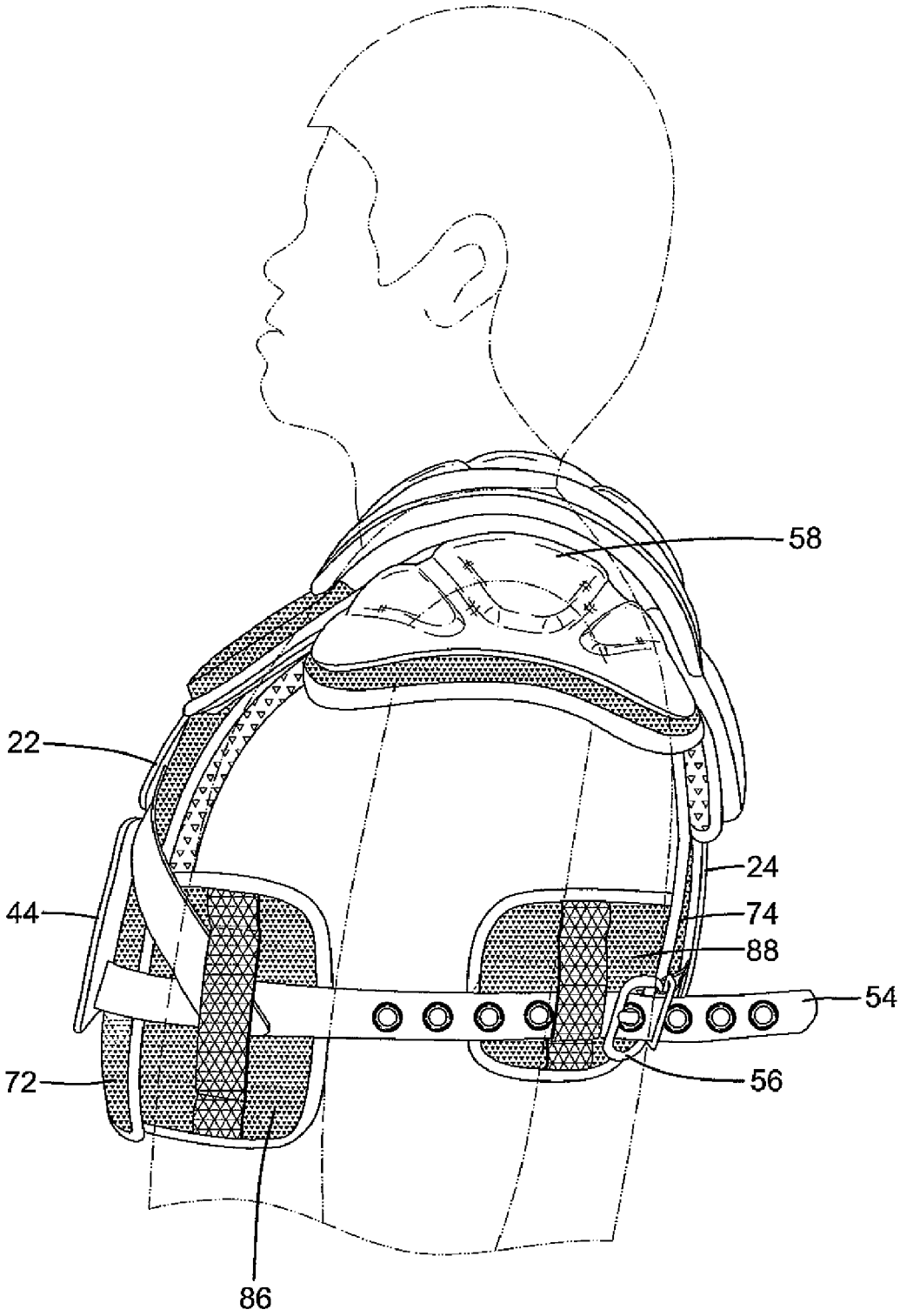
FIG. 7 shows the padding device of FIG. 2 worn on a wearer.

When wearing padding device 10 according to the preferred teachings of the present invention with straps 54 disengaged from buckles 56, the head of the wearer extends from lower opening 64 through upper opening 62 until the neck of the wearer is located between lining strips 85. Arms of the wearer extend out of padding device 10 via side openings 66, as shown in FIG. 7. Front sides 72 of linings 12 abut the chest of the wearer, and rear sides 74 of linings 12 abut the back of the wearer. Straps 54 are engaged with buckles 56 and then adjusted to a desired tightness to change the spacing between rear sections 24 and front sections 22/front guard board 44. Lining strips 85 are of suitable thickness and softness to protect the neck of the wearer from being injured by rigid main pads 20.

Heat generated by the wearer during sporting can be dissipated through first, second, and third vents 92, perforations 36, and apertures 52. Note that each perforation 36 is aligned with one of first vents 92 to provide an air passageway. The ventilation/dissipating effect is, thus, enhanced. Since first, second, and third vents 92 are located in reinforced portions 34, reinforcing blocks 35, and reinforced sections 50, the impact-resistant properties of padding device 10 are not adversely affected. Furthermore, inner peripheries 93 of first, second, and third vents 92 are covered and protected by first, second, and third enveloping members 82 while providing an aesthetically pleasing appearance.

Now that the basic teachings of the present invention have been explained, many extensions and variations will be obvious to one having ordinary skill in the art. For example, first and second engaging members 81 and 88 can be removed if desired. Furthermore, the number, size, and shape of first, second, and third vents 92 can be varied according to needs.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A padding device comprising:

two arcuate main pads each including a front section, a rear section, and a shoulder section intermediate the front and rear sections, with each of the two main pads further including an outer, first surface and an inner, second surface, with a plurality of perforations extending from the outer, first surface through the inner, second surface, with a first interconnecting member mounted to the shoulder section of the inner, second surface of each of the two main pads, with the two main pads connected to each other;

two first assembling members each fixed to the front section of the inner, second surface of one of the two main pads;

two linings each formed of a buffer pad, with each of the two linings including front and rear sides and a top side intermediate the front and rear sides, with each of the two linings further including outer and inner layers, with each of the two linings further including a first vent extending from the outer layer through the inner layer, with the first vent of each of the two linings including a first inner periphery in the buffer pad, with a second interconnecting member mounted to the outer layer of the top side of each of the two linings;

two first enveloping members each including first and second ends, with the first end of each of the two first enveloping members fixed to the inner layer of one of the two linings, with each of the two first enveloping members surrounding one of the first vents;

two annular second assembling members each engaged to the second end of one of the first enveloping members; and a front guard board located below the front sections of the two main pads, with the front guard board including two protruded reinforced sections, with the front guard board including outer and inner faces, with a plurality of apertures extending from the outer face through the inner face of each of the reinforced sections, with each of the first enveloping members enveloping the inner periphery of one of the first vents but not covering the first vent, with each of the second assembling members located on an outer side of the outer layer of one of the two main pads, with each of the two linings being engaged to the inner, second surface of one of the two main pads with the front side aligned with the front section, with the rear side aligned with the rear section, with the top side aligned with the shoulder section, with each of the first interconnecting members releasably engaged with one of the second interconnecting members, with each of the second assembling members releasably engaged with one of the first assembling members to keep the inner periphery of each of the first vents enveloped by one of the first enveloping members, with the outer layer of each of the two linings abutting the inner, second surface of one of the two main pads, with the top sides of the two linings together defining an upper opening, with the front sides and the rear sides of the two linings together defining a lower opening and two side openings, with each of the perforations aligned with one of the first vents to provide an air passageway, with each of the two main pads including a protruded reinforced portion in an area on the outer, first surface corresponding to the first vent for enhancing impact resistance of the area, with each of the two main pads including a protruded reinforcing block on the outer, first surface, with each of the two linings further including a second vent extending from the outer layer through the inner layer of the rear side, with each of the second vents having a second inner periphery in the buffer pad, with the inner layer of each of the two linings including a second enveloping member surrounding one of the second vents, with each of the second enveloping members including first and second ends, with the first end of each of the second enveloping members fixed to the inner layer of one of the two linings, with an additional second assembling member fixed to the second end of each of the second enveloping members, with each of the second enveloping members enveloping the inner periphery of one of the second vents but not covering the second vent, with the each of the additional second assembling members located on the outer side of the outer layer of one of the two main pads and releasably engaged with one of two additional first assembling members on the rear sections of the two main pads.

2. The padding device for sports as claimed in claim 1, with the front guard board further including two extra first assembling members on the inner face corresponding to the two reinforced sections, with the front side of each of the two linings including a third vent extending from the outer layer through the inner layer and located below the first vent, with each of the third vents having a third inner periphery, with a third enveloping member fixed to the inner layer of each of the two linings and surrounding the third vent, with an extra second assembling member fixed to the second end of each of the third enveloping members, with each of the third enveloping members enveloping the inner periphery of one of the third vents but not covering the third vent, with the each of the extra second assembling members located on the outer side of the outer layer of one of the two main pads and releasably engaged with one of the two extra first assembling members on the front guard board.

3. The padding device for sports as claimed in claim 2, with each of the first, second, and third enveloping members including first and second sides, with the first side of the first end of each of the first enveloping members fixed to the inner layer of one of the two linings and surrounding one of the first vents, with each of the second assembling members fixed to the second side of the second end of one of the first enveloping members, with the first side of the first end of each of the second enveloping members fixed to the inner layer of one of the two linings and surrounding one of the second vents, with each of the additional second assembling members fixed to the second side of the second end of one of the second enveloping members, with the first side of the first end of each of the third enveloping members fixed to the inner layer of one of the two linings and surrounding one of the third vents, with each of the extra second assembling members fixed to the second side of the second end of one of the third enveloping members.

4. The padding device for sports as claimed in claim 2, further comprising: two first connecting members, with one of the two first connecting members interconnecting the front sections of the two main pads, with the other of the two first connecting members interconnecting the rear sections of the two main pads.

5. A padding device comprising:

two arcuate main pads each including a front section, a rear section, and a shoulder section intermediate the front and rear sections, with each of the two main pads further including an outer, first surface and an inner, second surface, with a plurality of perforations extending from the outer, first surface through inner, second surface, with a first interconnecting member mounted to the shoulder section of the inner, second surface of each of the two main pads, with the two main pads connected to each other;

two first assembling members each fixed to the front section of the inner, second surface of one of the two main pads;

two linings each formed of a buffer pad, with each of the two linings including front and rear sides and a top side intermediate the front and rear sides, with each of the two linings further including outer and inner layers, with each of the two linings further including a first vent extending from the outer layer through the inner layer, with the first vent of each of the two linings including a first inner periphery in the buffer pad, with a second interconnecting member mounted to the outer layer of the top side of each of the two linings;

two first enveloping members each including first and second ends, with the first end of each of the two first enveloping members fixed to the inner layer of one of the two linings, with each of the two first enveloping members surrounding one of the first vents;

two annular second assembling members each engaged to the second end of one of the first enveloping members; and a front guard board located below the front sections of the two main pads, with the front guard board including two protruded reinforced sections, with the front guard board including outer and inner faces, with a plurality of apertures extending from the outer face through the inner face of each of the reinforced sections, with each of the first enveloping members enveloping the inner periphery of one of the first vents but not covering the first vent, with each of the second assembling members located on an outer side of the outer layer of one of the two main pads, with each of the two linings being engaged to the inner, second surface of one of the two main pads with the front side aligned with the front section, with the rear side aligned with the rear section, with the top side aligned with the shoulder section, with each of the first interconnecting members releasably engaged with one of the second interconnecting members, with each of the second assembling members releasable engaged with one of the first assembling members to keep the inner periphery of each of the first vents enveloped by one of the first enveloping members, with the outer layer of each of the two linings abutting the inner, second surface of one of the two main pads, with the top sides of the two linings together defining an upper opening, with the front sides and the rear sides of the two linings together defining a lower opening and two side openings, with each of the perforations aligned with one of the first vents to provide an air passageway, with the outer layer of each of the two linings including a first engaging member surrounding but not covering one of the first vents, with a second engaging member fixed to the second end of each of the first enveloping members and releasably engaged with one of the first engaging members, with each of the two main pads including a protruded reinforced portion in an area on the outer, first surface corresponding to the first vent for enhancing impact resistance of the area, with each of the two main pads including a protruded reinforcing block on the outer, first surface, with each of the two linings further including a second vent extending from the outer layer through the inner layer of the rear side, with each of the second vents having a second inner periphery in the buffer pad, with the inner layer of each of the two linings including a second enveloping member surrounding one of the second vents, with each of the second enveloping members including first and second ends, with the first end of each of the second enveloping members fixed to the inner layer of one of the two linings, with an additional second assembling member fixed to the second end of each of the second enveloping members, with each of the second enveloping members enveloping the inner periphery of one of the second vents but not covering the second vent, with the each of the additional second assembling members located on the outer side of the outer layer of one of the two main pads and releasably engaged with one of two additional first assembling members on the rear sections of the two main pads.

6. The padding device for sports as claimed in claim 5, with the front guard board further including two extra first assembling members on the inner face corresponding to the two reinforced sections, with the front side of each of the two linings including a third vent extending from the outer layer through the inner layer and located below the first vent, with each of the third vents having a third inner periphery, with a third enveloping member fixed to the inner layer of each of the two linings and surrounding the third vent, with an extra second assembling member fixed to the second end of each of the third enveloping members, with each of the third enveloping members enveloping the inner periphery of one of the third vents but not covering the third vent, with the each of the extra second assembling members located on the outer side of the outer layer of one of the two main pads and releasably engaged with one of the two extra first assembling members on the front guard board.

7. The padding device for sports as claimed in claim 6, with each of the first, second, and third enveloping members including first and second sides, with the first side of the first end of each of the first enveloping members fixed to the inner layer of one of the two linings and surrounding one of the first vents, with each of the second assembling members fixed to the second side of the second end of one of the first enveloping members, with the first side of the first end of each of the second enveloping members fixed to the inner layer of one of the two linings and surrounding one of the second vents, with each of the additional second assembling members fixed to the second side of the second end of one of the second enveloping members, with the first side of the first end of each of the third enveloping members fixed to the inner layer of one of the two linings and surrounding one of the third vents, with each of the extra second assembling members fixed to the second side of the second end of one of the third enveloping members.

8. The padding device for sports as claimed in claim 6, further comprising: two first connecting members, with one of the two first connecting members interconnecting the front sections of the two main pads, with the other of the two first connecting members interconnecting the rear sections of the two main pads.

* * * * *